US005443575A

United States Patent [19]

Huang

[11] Patent Number: 5,443,575

[45] Date of Patent: Aug. 22, 1995

[54] RACQUET STRINGING

[76] Inventor: Ben Huang, 19472 Woodlands La., Huntington Beach, Calif. 92648

[21] Appl. No.: 136,333

[22] Filed: Oct. 13, 1993

[51] Int. Cl.[6] ..... A63B 51/02
[52] U.S. Cl. ..... 273/73 D; 273/73 R
[58] Field of Search ..... 273/73 R, 73 A, 73 B, 273/73 D, 73 C

[56] References Cited

U.S. PATENT DOCUMENTS

| | | | |
|---|---|---|---|
| 4,131,279 | 12/1978 | Ogden | 273/73 D |
| 4,330,132 | 5/1982 | Ferrari | 273/73 D |
| 4,408,760 | 10/1983 | Ferrari | 273/73 D |
| 5,346,212 | 9/1994 | Kuebler | 273/73 D |

FOREIGN PATENT DOCUMENTS

| | | | |
|---|---|---|---|
| 0560015 | 9/1993 | European Pat. Off. | 273/73 D |

OTHER PUBLICATIONS

"Main Strings", *The Stringer's Digest,* 1987, p. 10.

*Primary Examiner*—William E. Stoll
*Attorney, Agent, or Firm*—Fulwider, Patton, Lee & Utecht

[57] ABSTRACT

A method of stringing a tennis racquet with dual taper strings so as to dispose the smallest diameter strings at the approximate center of the string bed defined by the strings, with the diameter of the string's increasing from such center to the periphery of the frame head. A second method provides a double string bed where the dual taper strings extend over the front and rear faces of the frame head.

4 Claims, 11 Drawing Sheets

RACQUET STRINGING

BACKGROUND OF THE INVENTION

Conventional tennis racquet strings are of a uniform diameter throughout their length. Although it would be desirable to provide a string of comparatively small diameter to provide improved playing characteristics, e.g., power and control, known smaller diameter strings are not sufficiently durable to provide a long service life. While tennis racquet strings of conventional diameter provide durability, such strings cannot provide the desirable characteristics of a smaller-diameter string.

Conventional tennis racquets are provided with a single string bed of overlapped longitudinal and transverse strings. With this conventional stringing arrangement, tennis balls striking the frame portion of the racquet cannot be returned with the accuracy obtainable where the ball strikes the main playing portion of the string bed.

SUMMARY OF THE INVENTION

The present invention provides a dual taper racquet string which is so positioned within the head of the racquet frame that the smallest diameter segment of the string is positioned at the center of the string bed, with the string diameter gradually increasing outwardly from such center portion to where the string is attached to the frame. The string's maximum diameter segment is attached to the racquet frame where maximum stress is applied to the string. This arrangement provides optimum playing characteristics of the racquet and prolongs life of the string playability, while the connection between the string and the frame affords the durability achieved by conventional strings of a uniform larger diameter.

Additionally, the present invention provides a method and apparatus for making such dual taper strings.

The present invention also provides a tennis racquet provided with a double string bed, one bed being looped over the front face of the tennis racquet frame, and the other string bed being looped over the rear face of such frame. With this arrangement, maximum control of the tennis ball can be achieved, even where the ball strikes the portion of the racquet adjacent the frame. Accordingly, mis-hits of the ball adjacent the frame, or even off of the frame, have a greater chance of being viable shots.

DETAILED DESCRIPTION OF THE PREFERRED EMBODIMENTS

Figure 1:
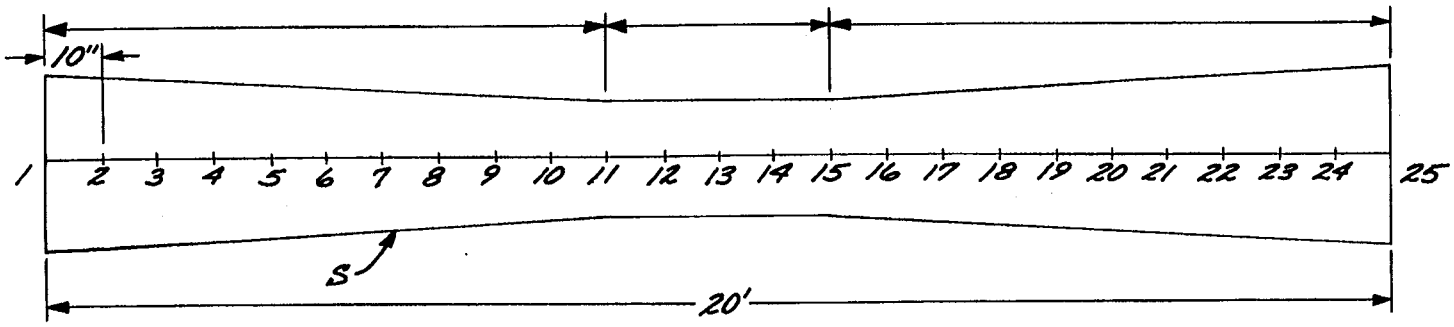
FIG. 1 is a schematic longitudinal view of a dual taper racquet string embodying the present invention.

FIG. 1 of the drawings should be considered in conjunction with Table 1 hereinbelow:

Referring now to FIG. 1 there is shown in exaggerated scale a 20′ length of dual taper string S made in accordance with the present invention. In this figure, the varying diameter of a 20′ length of string is shown, with numerals 1–25 appearing at 10″ increments along the length of the string.

FIG. 1 should be considered in connection with Table 1, which appears below:

TABLE 1

| STRING LOCATION | STRING DIAMETER (mm) |
|---|---|
| NO. 1 | 1.40 |
| NO. 2 | 1.39 |
| NO. 3 | 1.38 |
| NO. 4 | 1.35 |
| NO. 5 | 1.30 |
| NO. 6 | 1.29 |
| NO. 7 | 1.28 |
| NO. 8 | 1.27 |
| NO. 9 | 1.26 |
| NO. 10 | 1.26 |
| NO. 11 | 1.26 |
| NO. 12 | 1.25 |
| NO. 13 | 1.25 |
| NO. 14 | 1.25 |
| NO. 15 | 1.26 |
| NO. 16 | 1.26 |
| NO. 17 | 1.26 |
| NO. 18 | 1.27 |
| NO. 19 | 1.28 |
| NO. 20 | 1.29 |
| NO. 21 | 1.30 |
| NO. 22 | 1.35 |
| NO. 23 | 1.38 |
| NO. 24 | 1.39 |
| NO. 25 | 1.40 |

Referring now to Table 1, at the left end location 1 in FIG. 1, the string diameter is 1.40 mm. Such diameter is gradually reduced to the point designated 12 in FIG. 1 to 1.25 mm. The 1.25 mm diameter continues through point 14 on FIG. 1. From point 14, the right-hand portion of the string increases at a uniform rate to 1.4 mm at the right end of the string.

Referring now to Table 2, there is shown a comparison of the tensile strength and the knot strength of the dual taper string S of FIG. 1 at various longitudinal points along the string. Note that the tensile and knot strength are symmetrically similar around the string's mid-point location designated 13 in FIG. 1.

TABLE 2

| STRING LOCATION | TENSILE STRENGTH (Kgs) | KNOT STRENGTH (Kgs) |
|---|---|---|
| NO. 1 | 51.5 | 41 |
| NO. 2 | 52.5 | 41.5 |
| NO. 3 | 54 | 42 |
| NO. 4 | 56.5 | 43 |
| NO. 5 | 58 | 43.5 |
| NO. 6 | 60 | 43.5 |
| NO. 7 | 63 | 44 |
| NO. 8 | 64.5 | 44.5 |
| NO. 9 | 65 | 45 |
| NO. 10 | 66 | 45 |
| NO. 11 | 66 | 45 |
| NO. 12 | 66 | 44.5 |
| NO. 13 | 65 | 45 |

Figure 3:
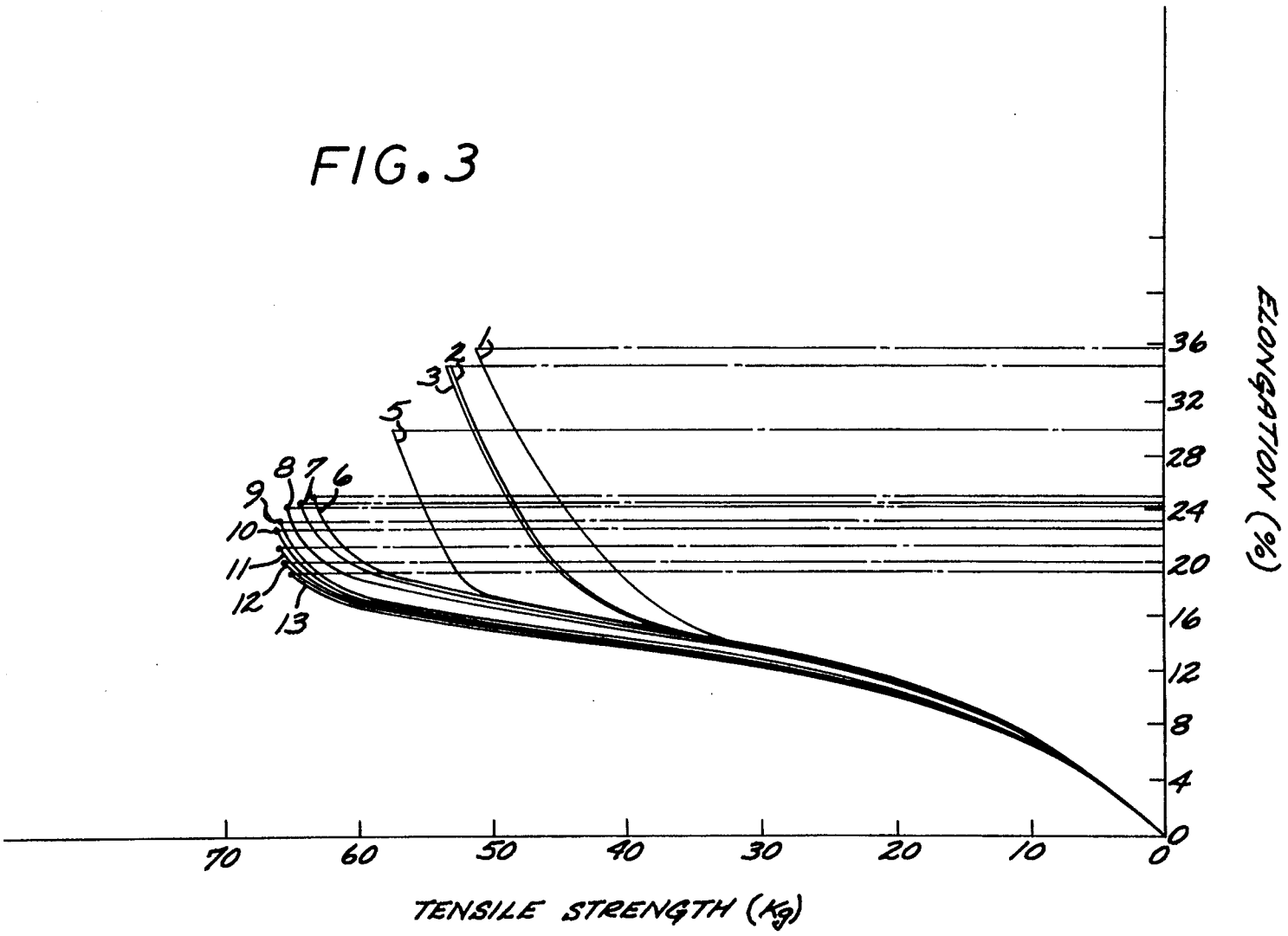
FIG. 3 is a tensile strength-elongation graph of a dual taper string embodying the present invention.

Referring to Table 2, the tensile strength and knot strength of the representative dual taper string S are seen to increase as the string's cross section and elongation decreases. Thus, at string location No. 1 in FIG. 1, the tensile strength of the string is 51.5(Kgs), and its knot strength is 41(Kgs). It should be understood that the higher the knot strength, the greater the shear strength of the string. As the diameter of the string is reduced to its minimum at point 13 on FIG. 1, the tensile strength of the string has increased to 65(Kgs), and the knot strength has increased to 45(kgs). The information appearing in Table 2 is embodied in the graph shown in FIG. 3. Referring thereto, the dual taper string's tensile strength is shown by the horizontal coordinate in kilograms, while the elongation percentage is shown by the vertical coordinate. The location points 1–25 on the string S depicted in FIG. 1 are designated at the upper end of each of the plots.

Figure 2:
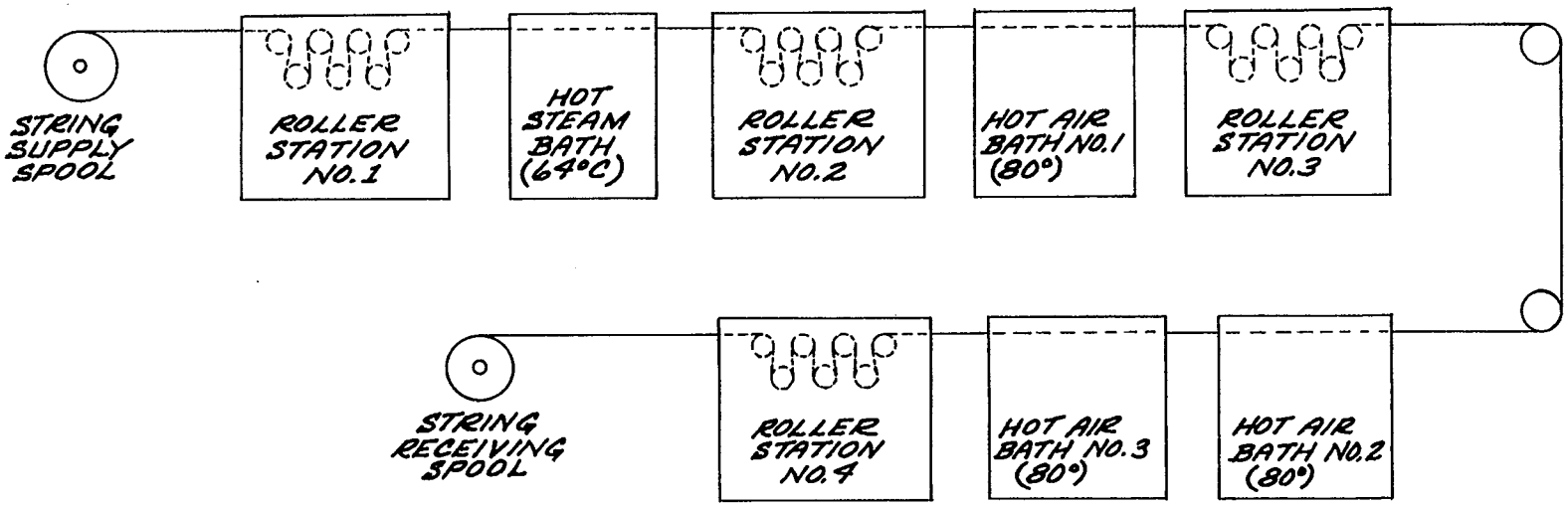
FIG. 2 is a diametric view of an apparatus and method for forming the dual taper string of FIG. 1.

Referring now to FIG. 2, there is schematically shown a method and apparatus for efficiently forming the dual taper string S shown in FIG. 1. Multifilament string of 1.4 mm diameter is fed from a string supply spool over a series of sets of stretching rollers and through a series of baths onto a string receiving spool. The stretching rollers are all 31.5 cm in diameter. The rollers of roller stations Nos. 2 and 3 both rotate at a constant 10 rpm, while the rollers of roller station No. 4 rotate at a constant 9 rpm. The hot steam bath is maintained at 64° C. and nominally 100% relative humidity while hot air bath Nos. 1, 2 and 3 are maintained at 80° C. By varying the rotational speed of the stretching rollers of station No. 1 relative to the rotational speed of the stretching rollers of station No. 2, a varying amount of stretching, and hence, diameter reduction is achieved. Matching the speed of stretching rollers of station No. 1 to that of the stretching rollers of station No. 2 causes no stretching to occur, whereby string diameter remains unchanged. Reducing the speed of the stretching rollers of station No. 1 relative to that of the stretching rollers of station No. 2 causes stretching which results in a reduced string diameter. Gradual variation of the rotational speed of stretching rollers No. 1 yields a gradual taper in the string.

Figure 14:
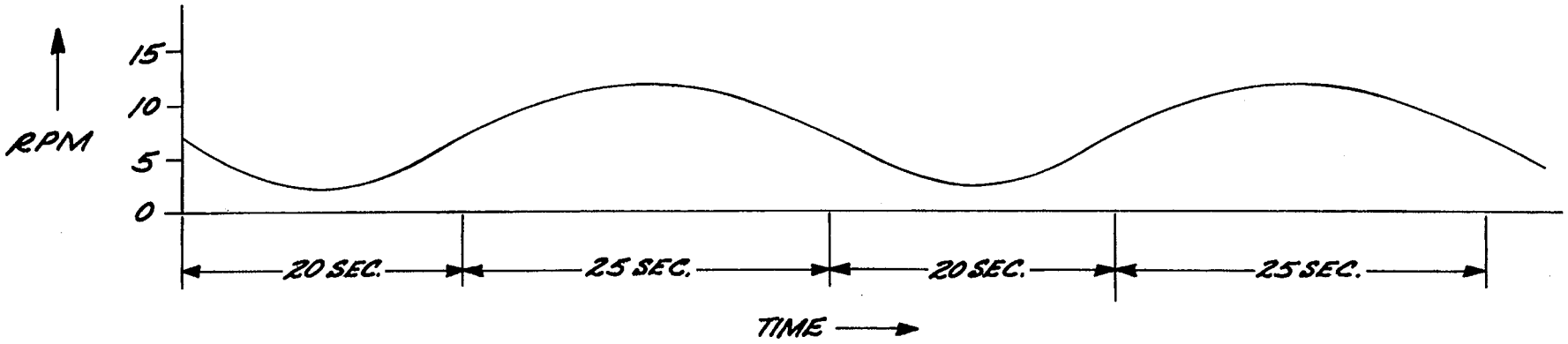
FIG. 14 graphically illustrates the cyclical variation of the rotational speed of the stretching rollers of station No. 1.

It has been found that the substantially sinusoidal variation of the rotational speed of the stretching rollers of station No. 1 in the manner shown in the graph of FIG. 14 yields the preferred string diameter profile shown in FIG. 1. As per FIG. 14, the rotational speed of the stretching rollers of station No. 1 is gradually adjusted between a minimum of 2 rpm to a maximum of 12 rpm. More specifically, the speed is reduced from 7 to 2 rpm, and again increased to 7 rpm over the course of 20 seconds. In the next 25 seconds, the speed is increased from 7 rpm to 12 rpm and then decreased back to 7 rpm. The brief period of time that the rotational speed of the rollers of station No. 1 exceeds the rotational speed of the rollers of station No. 2 allows the string to relax, but does not result in slack. The speed differential between the rollers of station Nos. 3 and 4 similarly allows some relaxation to occur. Continuously repeating the pattern of varying the rotational speed of roller station No. 1 as illustrated in FIG. 14 yields a bulk quantity of string of varying diameter. Subsequently cutting the processed string at the center of the resulting sections of maximum diameter yield 20′ lengths having the profile shown in FIG. 1. In order to manufacture a 40′ length with the same overall profile, the time required to vary the speed is doubled, i.e., speed variation from 7 rpm to 2 rpm to 7 rpm, takes 40 seconds, while variation from 7 rpm to 12 rpm to 7 rpm requires 50 seconds.

Figure 4:
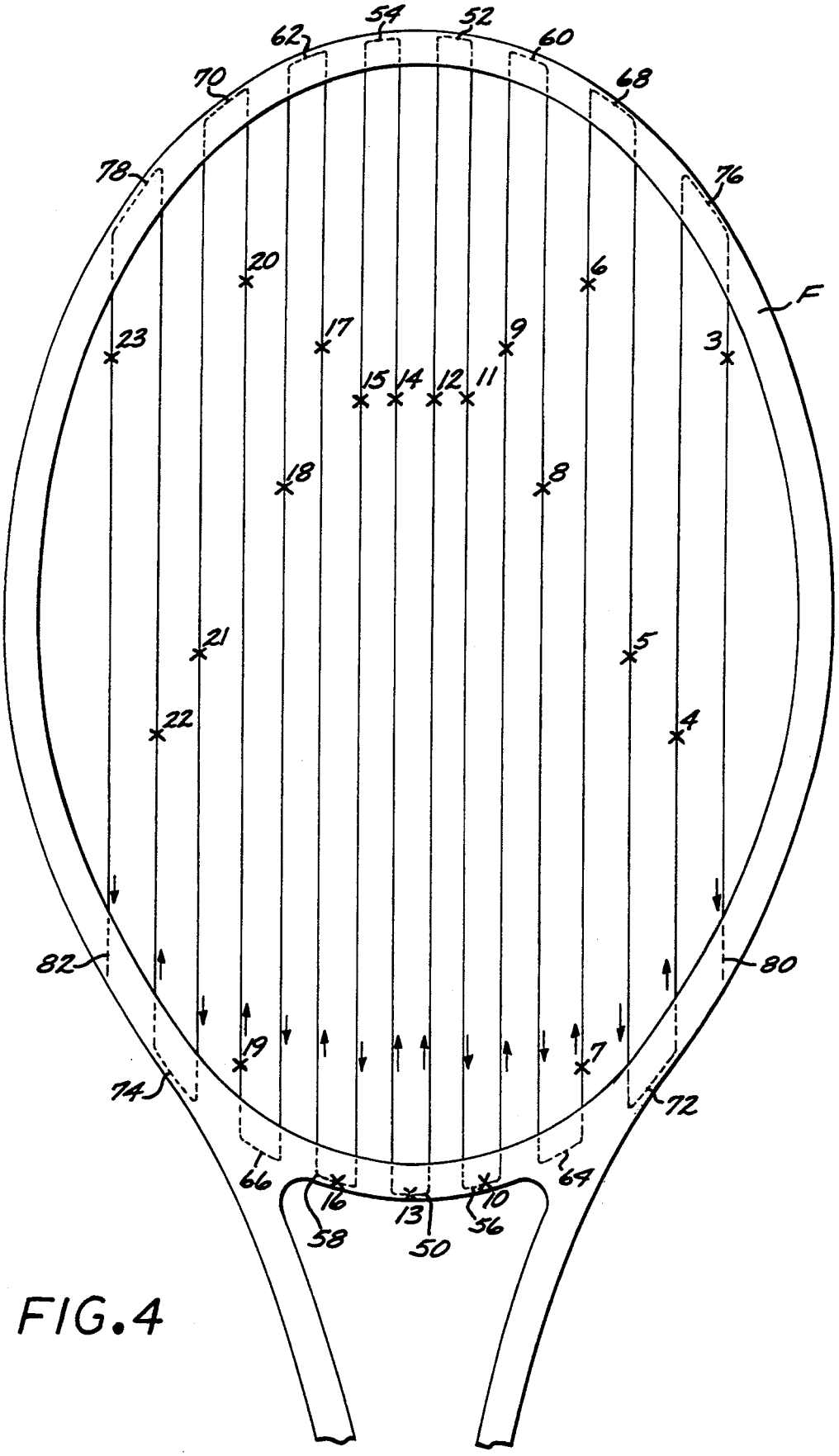
FIG. 4 is a front elevational view of a tennis racquet frame during stringing of such frame with a dual taper string in a vertical direction.
Figure 5:
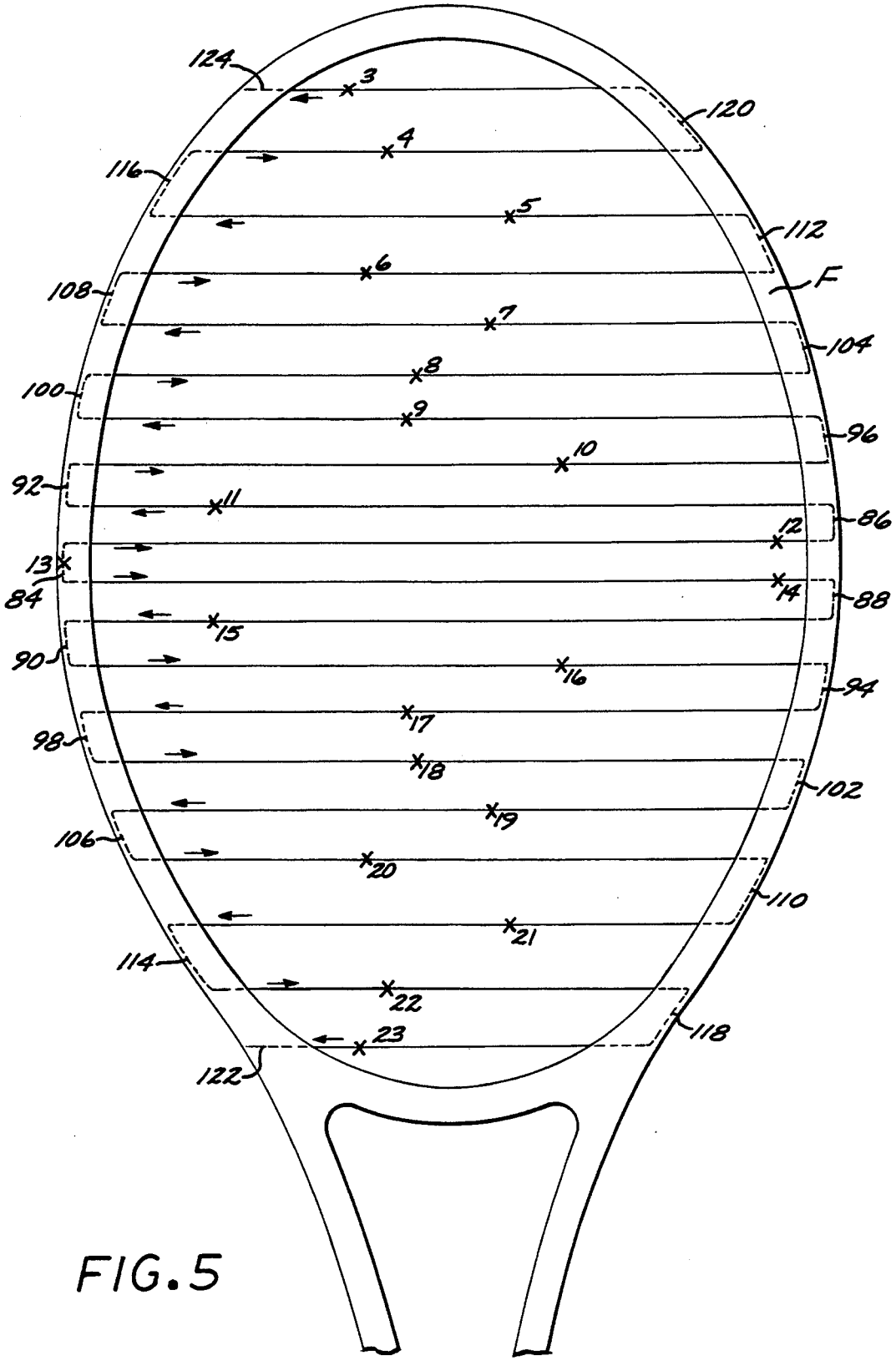
FIG. 5 is a view similar to FIG. 4, but showing the stringing of a dual taper string in a horizontal direction.
Figure 6:
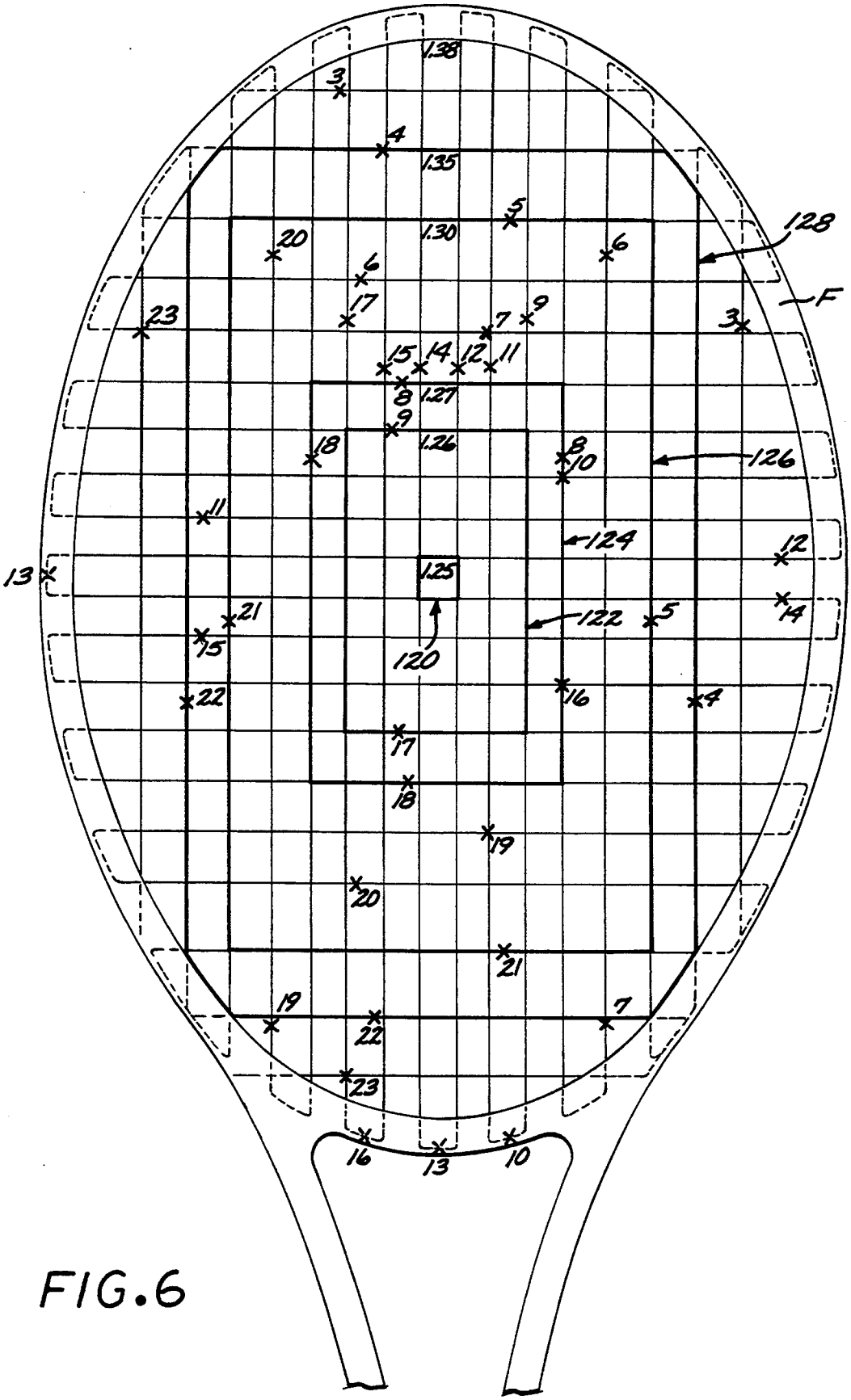
FIG. 6 is a view similar to FIGS. 4 and 5 showing a completed stringing of a tennis racquet with dual taper string.

Referring now to FIGS. 4, 5, and 6, there is shown a method of stringing the dual taper string S of the present invention on the frame F of a conventional tennis racquet. The numerical points 1–25 in FIG. 4 are correlated with the numerical points 1–25 in FIG. 1. It should be understood that a single 20′ length of string will be utilized for stringing the vertical strings, with another 20′ length of string being employed for the horizontal stringing.

As indicated in FIG. 4, the mid-point of 13 of string S will be positioned at the lower central portion of the racquet frame F, within the conventional stringing passages shown at 50 in dotted outline. From this central point of the racquet frame, the string S is extended upwardly and then through stringing passages 52 and 54 formed at the upper mid-portion of the racquet frame. String points 12 and 14, i.e., the smallest diameter portion of string S will fall where indicated in FIG. 4 within the central area of the string bed B. As the string is moved downwardly from frame passages 52 and 54, string points 11 and 15 will be in substantial horizontal alignment with string points 12 and 14. From points 11 and 15, the string is pulled downwardly into racquet frame string passages 56 and 58 formed in the lower part of the racquet frame, with string points 10 and 16 being positioned within such passages. From passages 56 and 58, the string is again pulled upwardly and through string passages 60 and 62 formed at the top of the racquet frame, with string points 9 and 17 being positioned a comparatively short distance above string points 11, 12, 14 and 15. From string passages 60 and 62, the string is pulled downwardly and through string passages 64 and 66 formed in the bottom portion of the frame. Thereafter, the string is pulled upwardly and through string passages 68 and 70 formed in the upper portion of the frame, with string points 7 and 19 lying adjacent the lower portion of the frame, and string segments 6 and 20 positioned a short distance above string points 9 and 17. From string passages 68 and 70 in the top part of the frame F, the string is pulled downwardly and through string passages 72 and 74 formed in the lower portion of the frame, with string points 5 and 21 falling just below the horizonal central section of the string bed area. From lower string passages 72 and 74, the string is again pulled upwardly and through string passages 76 and 78 formed in the outer upper portion of the racquet frame, with points 4 and 22 falling a short distance below string points 5 and 21. Finally, the extremities of the string S are pulled downwardly from string passages 76 and 78 to be secured with a knot within string passages 80 and 82 formed within the lower portion of the frame, with string points 3 and 23 falling on a horizontal plane within the upper portion of the string bed area.

Any excess string will be cut off. With this arrangement, the smallest diameter segment of the string S designated by points 11, 12, 14 and 15 will be positioned adjacent the mid-portion of the string bed area.

Referring now to FIG. 5, there is shown the manner in which a length of dual taper string S is strung horizontally within the racquet frame F. The mid-portion of the string at point 13 is positioned within string passages 84 formed at the left center portion of the racquet frame. From this point, the string is pulled horizontally to the right and through string passages 86 and 88, with string points 12 and 14 lying adjacent the right-hand portion of the frame. From string passages 86 and 88, the string is pulled to the left and through the string passages 90 and 92, with points 11 and 15 lying towards the left-hand portion of the string bed area. From string passages 90 and 92, the string is pulled to the right and through string passages 94 and 96, with string points 10 and 16 lying a short distance to the right center of the string bed area. From string passages 94 and 96, the string is again pulled to the left and through string passages 98 and 100, with string points 8 and 9, and 17 and 18 being positioned to the left of the center of the string bed at approximately the same distance string point 10 is positioned to the right of the center of the string bed area. The string is then pulled to the right and through the string passages 102 and 104, with string points 6 and 7, and 20 and 19 being positioned approximately equal distances from the vertical center of the string bed area. The string is then pulled to the left through string passages 106 and 108. The string is then pulled to the right and through string passages 110 and 112, then to the left through string passages 114 and 116, and through string passages 118 and 120. Finally, the strings are pulled through string passages 122 and 124 formed at the left side of upper and lower portions of the side of the frame and secured in a conventional manner with a knot. Any excess string will be cut off.

Referring now to FIG. 6, there is shown a front elevational view of a completed stringing of tennis racquet frame F, with two lengths of dual taper string as described hereinbefore, and shown in FIGS. 4 and 5. It is important to recognize that the diameter of the string length locations between points 12 to 14 of both the vertical and horizontal strings is of the smallest string diameter, i.e., 1.25 mm. Accordingly, the small square formed at the center of the string bed by these vertical and horizontal strings defines a 1.25 mm area of the string bed as indicated at 120. It should further be understood that the diameter of the string length locations between points 9–17 of both the vertical and horizontal strings is 1.26 mm. In FIG. 6, the rectangular area formed by string segments 9–17 is designated 122. The next largest string bed area 124 is formed by the dual taper string S between length locations 8 and 18 in FIG. 1, i.e., 1.27 mm. The next largest rectangular string bed area designated at 126 in FIG. 6 is formed by the next largest diameter of the dual taper string S, i.e., 1.3 mm. The next largest rectangular string bed area designated at 128 and strings outwardly thereof are formed of string having the largest diameters. The outer strings defining the aforementioned rectangular string areas are shown in heavier lines than the lines utilized to show the remaining strings.

Figure 7:
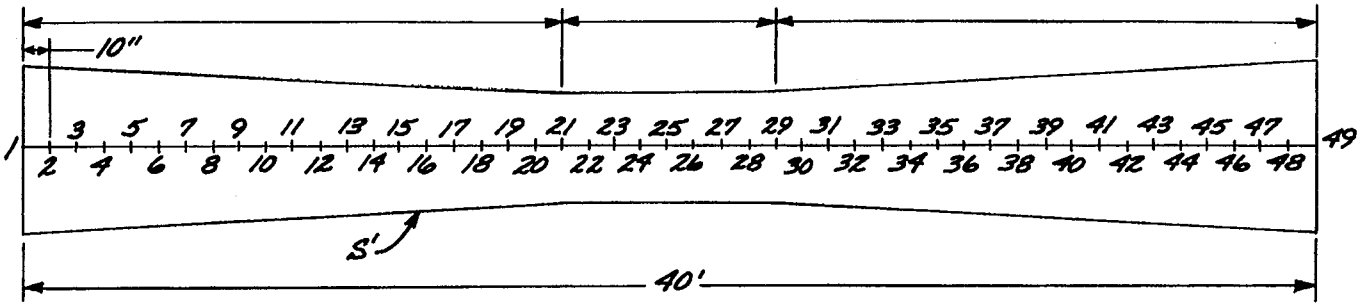
FIG. 7 is a schematic view of a dual taper string utilized to form a double string bed in accordance with the present invention.

It should be understood that the major portion of the vertical and horizontal strings which extend through the string passages are of the heaviest diameter, and accordingly, provide maximum durability at the points of connection of the strings with the racquet frame F. It should also be understood that by positioning the smaller diameter strings within the center portion of the string bed results in improved playability with respect to tennis balls hitting the center portion of such string bed because the "sweet spot" of the racquet becomes larger as compared to a tennis racquet strung in a conventional manner with uniform diameter string larger than 1.25 and 1.26 mm, the small diameter string being stiffer than conventional strings. It is also important to be understood that the stiffer small diameter string avoids loss of string bed tension as occurs in a tennis racquet strung in a conventional manner with uniform diameter string, and thus, prolongs life of the string playability. As noted hereinabove, the knot strength, and hence the shear strength of the smaller diameter string, is the greatest within the string bed areas defined by the small-diameter strings. Referring to FIG. 7, there is shown in exaggerated scale a 40′ length of dual taper string made in accordance with the present invention to be utilized in forming a double string bed.

FIG. 7 should be considered in accordance with the following Table 3:

TABLE 3

| STRING LOCATION | STRING DIAMETER (mm) |
|---|---|
| NO. 1 | 1.40 |
| NO. 2 | 1.40 |
| NO. 3 | 1.39 |
| NO. 4 | 1.39 |
| NO. 5 | 1.38 |
| NO. 6 | 1.38 |
| NO. 7 | 1.35 |
| NO. 8 | 1.35 |
| NO. 9 | 1.30 |
| NO. 10 | 1.30 |
| NO. 11 | 1.29 |
| NO. 12 | 1.29 |
| NO. 13 | 1.28 |
| NO. 14 | 1.28 |
| NO. 15 | 1.27 |
| NO. 16 | 1.27 |
| NO. 17 | 1.26 |
| NO. 18 | 1.26 |
| NO. 19 | 1.26 |
| NO. 20 | 1.26 |
| NO. 21 | 1.26 |
| NO. 22 | 1.25 |
| NO. 23 | 1.25 |
| NO. 24 | 1.25 |
| NO. 25 | 1.25 |
| NO. 26 | 1.25 |
| NO. 27 | 1.25 |
| NO. 28 | 1.25 |
| NO. 29 | 1.26 |
| NO. 30 | 1.26 |
| NO. 31 | 1.26 |
| NO. 32 | 1.26 |
| NO. 33 | 1.26 |
| NO. 34 | 1.27 |
| NO. 35 | 1.27 |
| NO. 36 | 1.28 |
| NO. 37 | 1.28 |
| NO. 38 | 1.29 |
| NO. 39 | 1.29 |
| NO. 40 | 1.30 |
| NO. 41 | 1.30 |

TABLE 3-continued

| STRING LOCATION | STRING DIAMETER (mm) |
|---|---|
| NO. 42 | 1.35 |
| NO. 43 | 1.35 |
| NO. 44 | 1.38 |
| NO. 45 | 1.38 |
| NO. 46 | 1.39 |
| NO. 47 | 1.39 |
| NO. 48 | 1.40 |
| NO. 49 | 1.40 |

Referring now to FIGS. 7 and Table 3, at the left end location in FIG. 7, the string diameter is 1.40 mm. Such diameter is gradually reduced to the point designated 22 to 1.25 mm. The 1.25 mm diameter continues through point 28. From point 28, the right-hand portion of the string increases at a uniform rate to 1.40 mm at the right end of the string shown in FIG. 7.

Figure 9:
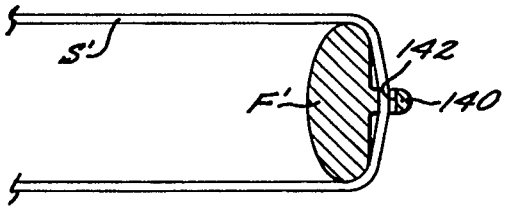
FIG. 9 is an enlarged sectional view taken along 9—9 of FIG. 8.
Figure 8:
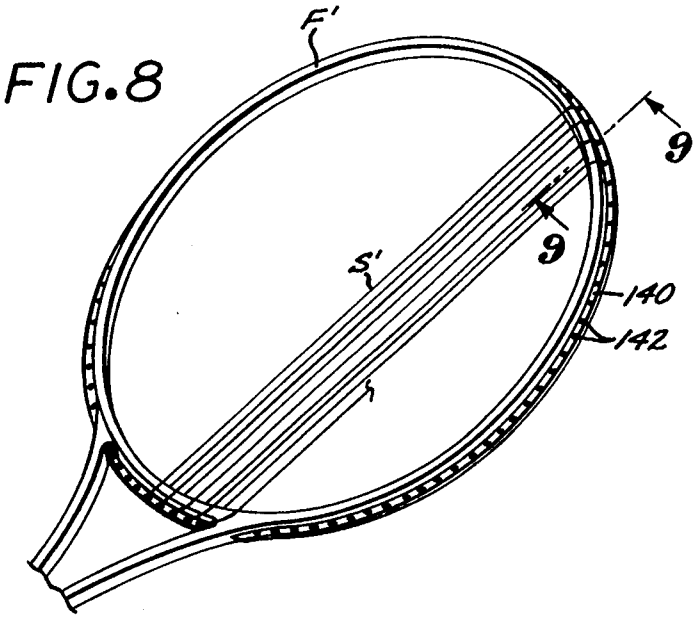
FIG. 8 is a broken perspective view showing a step in forming a double string bed in accordance with the present invention.
Figure 10:
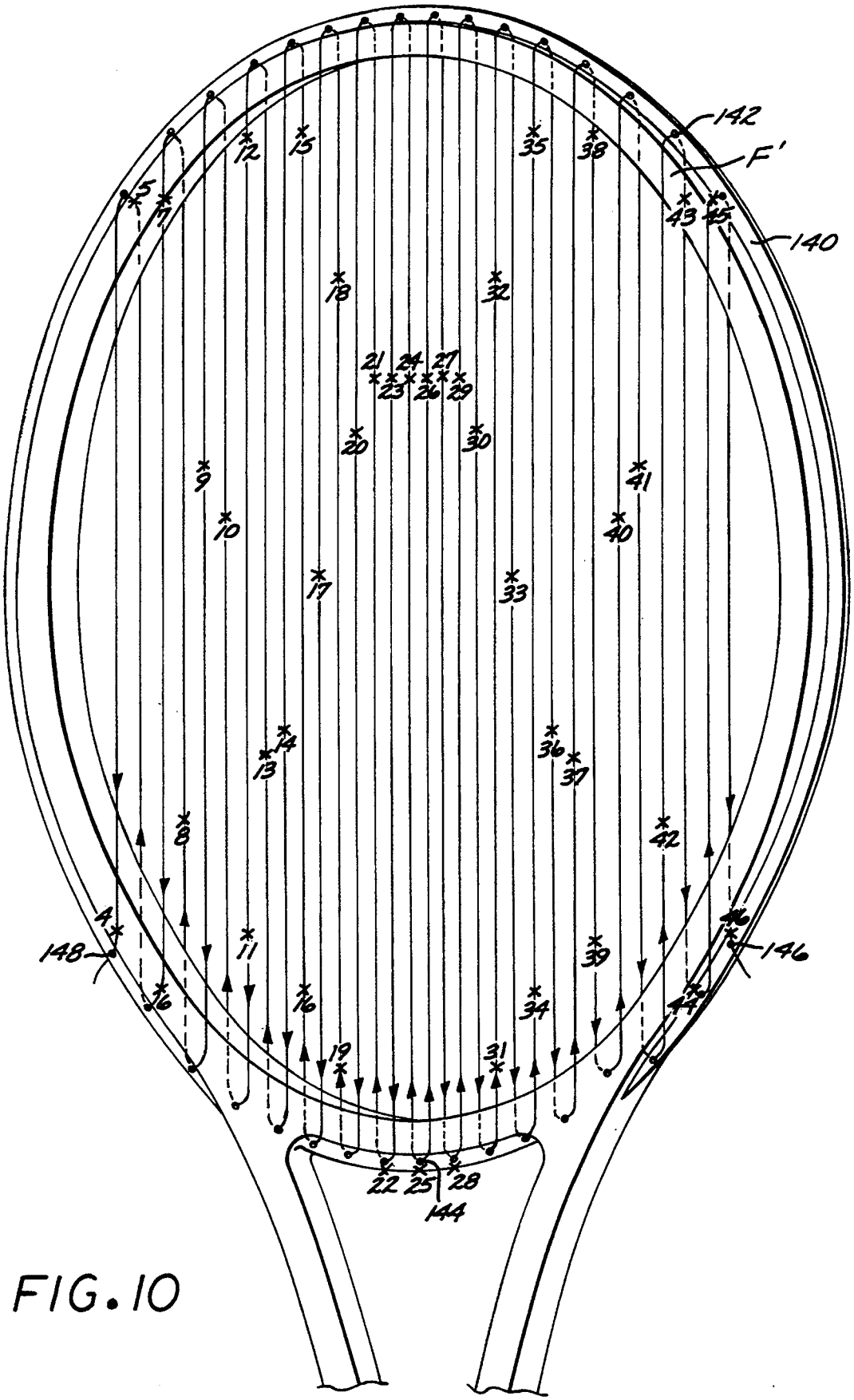
FIG. 10 is a front elevational view of a tennis racquet frame showing how a double string bed is looped over a tennis racquet frame in a vertical direction.

Referring now to FIGS. 8–13, there is shown how a double string bed embodying the present invention may be strung on the frame F′ of a tennis racquet. With reference to FIGS. 8 and 9, it should be noted that the frame F′ of the tennis racquet is provided with a peripheral flange 140 formed around its periphery. Flange 140 is provided with a plurality of like string-receiving apertures 142. In forming a double string bed, a 40′ length of dual taper string S′ as exemplified by FIG. 7 is first used to define the vertical strings, with a second length of such dual taper string being employed to form the horizontally extending strings of the double string bed. FIGS. 8 and 9 particularly show the manner in which the strings S′ are looped over the front and rear faces of the racquet frame F′, with such strings passing through apertures 142. FIG. 10 shows the racquet frame F′ after all of the vertical strings have been strung thereon.

In effecting such stringing, the mid-point 25 of string S′ of FIG. 7 will be positioned at the lower central portion of the racquet frame F′ through the lowermost frame aperture 144. From this point, the portions of the string opposite the mid-point thereof will be alternately pulled upwardly and downwardly over the front and rear faces of the frame through the frame apertures 142, with the outermost string length being secured within the apertures 146 and 148 formed at opposite sides of the lower portion of the racquet frame. Such outermost string lengths will be secured within these apertures by means of a knot, with any excess string being cut off. The longitudinal string points 1–49 shown in FIG. 7 will be positioned as indicated by the corresponding string location numbers shown distributed over the string bed area in FIG. 10.

Figure 11:
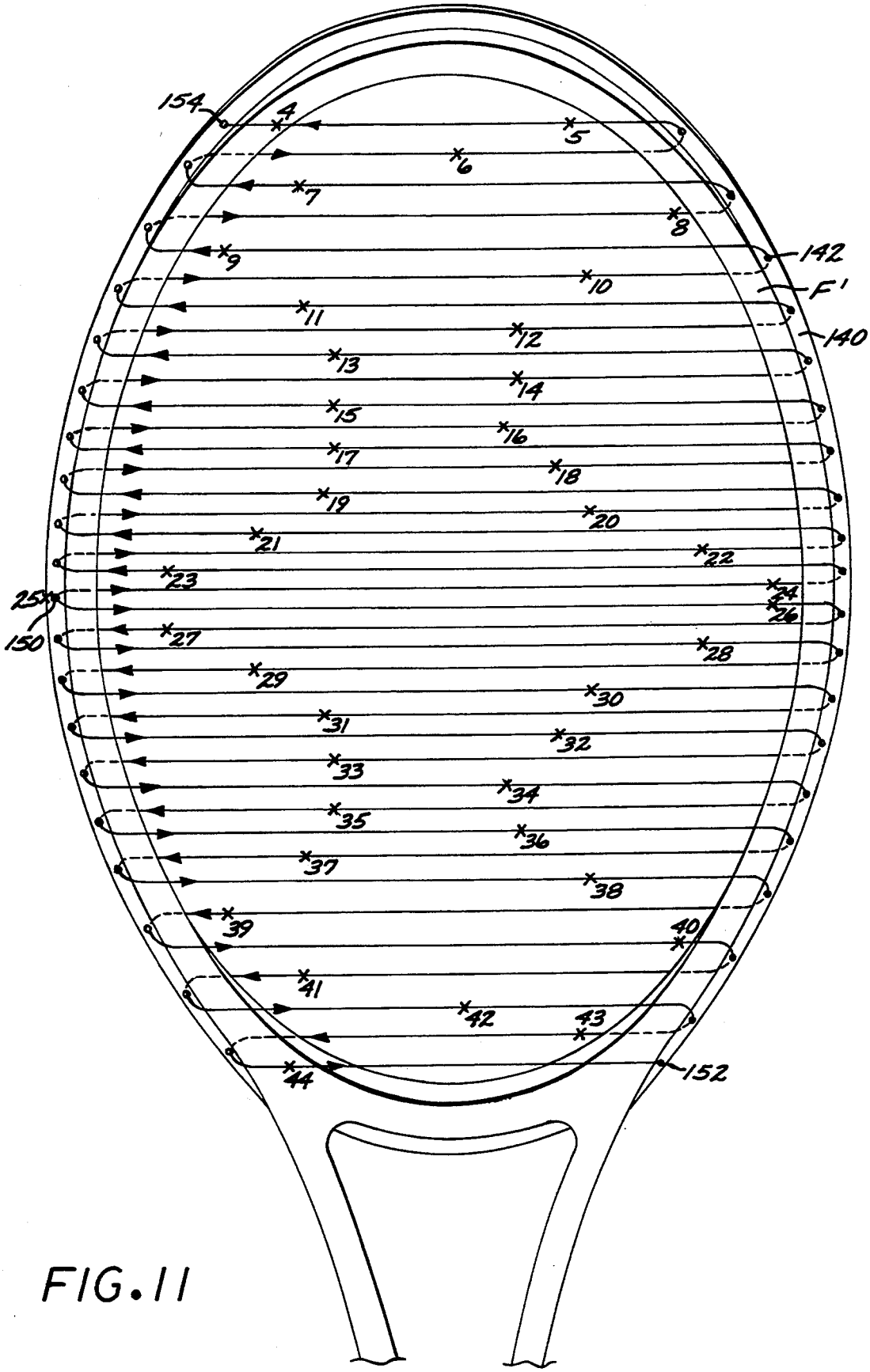
FIG. 11 is a view similar to FIG. 10 showing how a double string bed is looped over the frame in a horizontal direction.

Referring now to FIG. 11, the horizontal strings are strung within the string bed area by first positioning the mid-point 25 of a string S′ exemplified by FIG. 7. through flange aperture 150 at the left-hand mid portion of the racquet frame F′. From this point, the portions of the string S′ opposite the mid-point thereof will be alternately pulled horizontally over the front and rear faces of the frame through apertures 142. The lowermost horizontal string segment will be secured within the aperture 152 located at the lower right-hand portion of the frame by means of a knot, with any excess string being cut off. Similarly, the uppermost horizonal string segment will be secured within aperture 154 located at the left-hand portion of the racquet by means of a knot, with any excess string being cut off. The longitudinal string points 1–49 shown in FIG. 7 will be positioned as indicated by the corresponding string location numbers shown distributed over the string bed area in FIG. 11.

Figure 12:
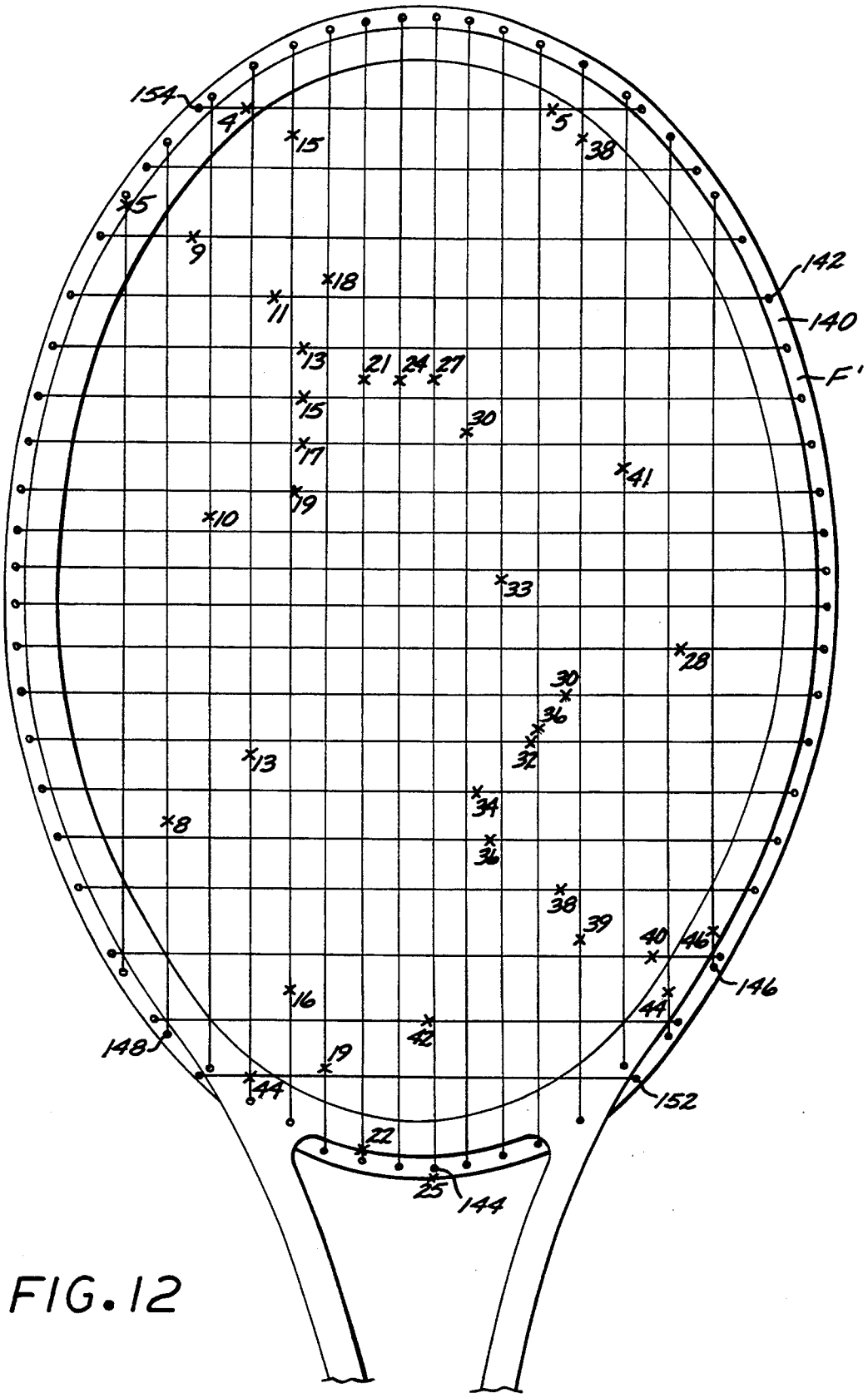
FIG. 12 is a front elevational view of a tennis racquet provided with a double string bed in accordance with the present invention.
Figure 13:
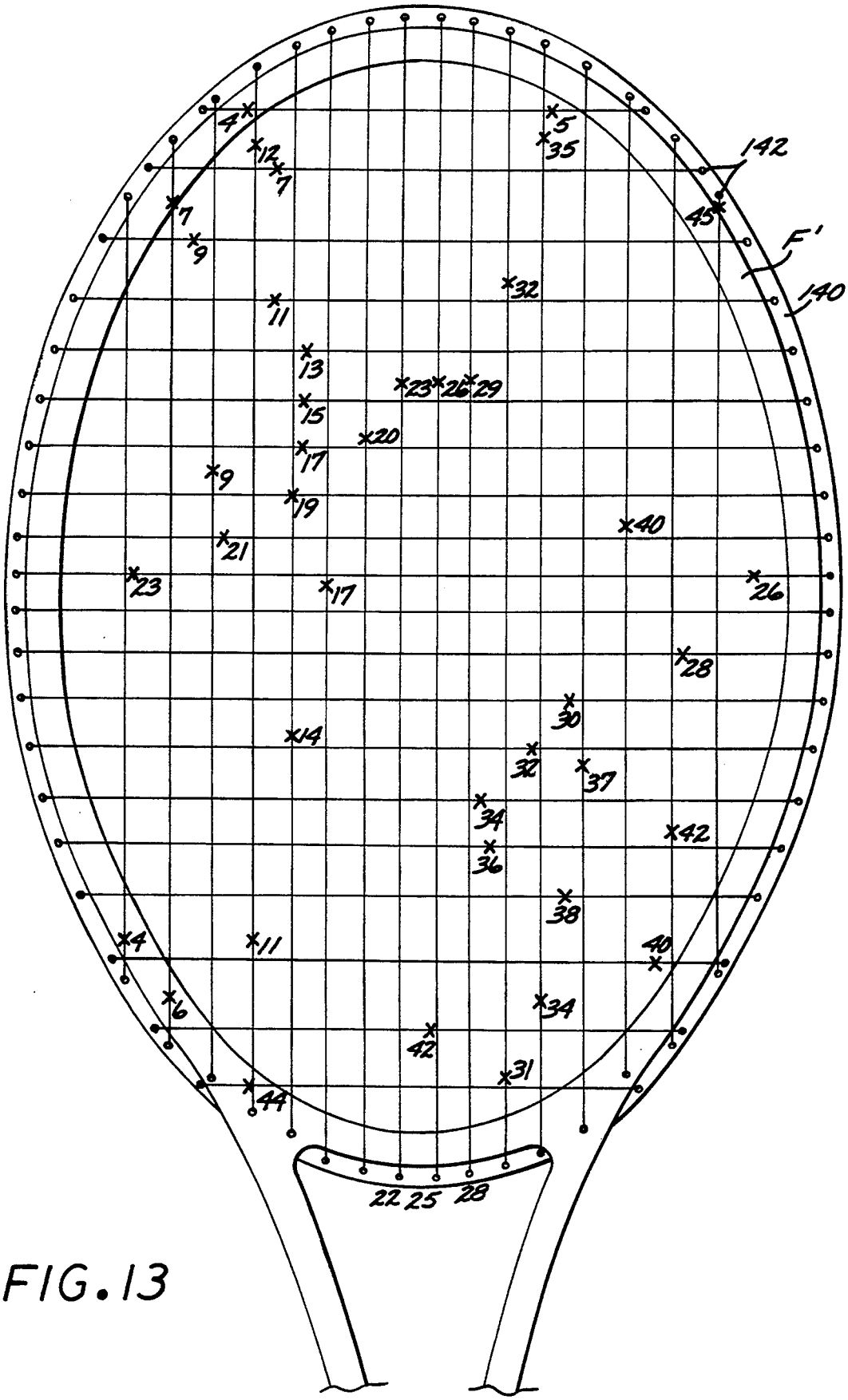
FIG. 13 is a rear elevational view of a tennis racquet frame provided with a double string bed in accordance with the present invention.

Referring now to FIG. 12, there is shown the front face of a double string bed formed in accordance with FIGS. 10 and 11 in the foregoing description. FIG. 13 is a view similar to FIG. 12, but showing the rear face of such racquet. As indicated in FIGS. 12 and 13, the smallest diameter segments of the vertical and horizontal strings are positioned at the center portion of the string bed area with the diameter of the strings increasing from the central area of the string to the connection of the major portion of the strings with the racquet frame. Accordingly, a double string bed fabricated in accordance with the present invention will provide the same playability and durability advantages provided by the single string bed embodiment of the present invention shown in FIGS. 1–6, and described in detail hereinabove. In addition to all of the benefits provided by the single string bed, the double string bed provides an added benefit, i.e, because the string beds of both front and back faces of the frame lie above the frame itself, the frame does not impede contact between the ball and string. Hence, even mis-hits close to the frame or even off of the frame have a greater chance of being viable shots.

Various modifications and changes may be made with respect to the above detailed description without departing from the spirit of the present invention.

I claim:

1. A method of stringing a racquet frame head with two lengths of dual taper strings, each such string length including a mid-portion of smallest diameter with the string uniformly increasing in diameter outwardly of said mid-portion to the ends of each such string, said method comprising:

attaching the mid-portion of one of the strings to the lower central portion of the racquet frame head;

vertically stringing the string segments disposed on opposite sides of the lower central portion of the frame head upwardly and downwardly along the width of the upper and lower portions of the racquet frame head;

attaching the free ends of said segments to the opposite sides of the racquet frame head;

attaching the mid-portion of the second of the strings to the intermediate portion of one side of the frame head;

horizontally stringing the segments of said second string disposed on opposite sides of said mid-portion upwardly and downwardly along the height of the racquet frame head starting from said intermediate portion;

attaching the free ends of such segments to an upper side and a lower side of the frame head; and whereby the smallest diameter portions of the first and second strings will be disposed at the approximate center of the string bed defined by said strings, with the diameter of most of the strings gradually increasing from the approximate center of the string bed to the periphery of the frame head.

2. A stringing method as set forth in claim 1 wherein the racquet frame head is formed with stringing passages through which the strings are extended to attach the strings to such frame head.

3. A stringing method as set forth in claim 1 wherein the diameter of the two lengths of string vary from about 1.25 mm at the mid-portion of each string to about 1.40 mm at each end of each string.

4. A stringing method as set forth in claim 3 wherein the length of each string approximates 22′.

* * * * *